United States Patent [19]

Moinard

[11] 4,260,289

[45] Apr. 7, 1981

[54] CONNECTION-DISCONNECTION DEVICE BETWEEN TUBING AND UNDERWATER WELLHEAD FOR USE WITH ARTICULATED PRODUCTION INSTALLATIONS

[75] Inventor: Michel Moinard, Bizanos, France

[73] Assignee: Societe Nationale Elf Aquitaine (Production), France

[21] Appl. No.: 48,617

[22] Filed: Jun. 14, 1979

[30] Foreign Application Priority Data

Jun. 21, 1978 [FR] France ..... 78 18533

[51] Int. Cl.[3] ..... E21B 7/12; F16L 1/04

[52] U.S. Cl. ..... 405/169; 166/351; 166/338; 405/170

[58] Field of Search ..... 405/168, 169, 170, 195; 166/338, 339, 346, 350, 367, 368, 340, 343, 344, 351; 285/29; 29/429

[56] References Cited

U.S. PATENT DOCUMENTS

| | | | |
|---|---|---|---|
| 3,041,090 | 6/1962 | Ashe et al. . | |
| 3,189,372 | 6/1965 | Johnson | |
| 3,448,799 | 6/1969 | Ahlstone | 166/368 X |
| 3,516,492 | 6/1970 | Petersen | 166/344 X |
| 3,517,737 | 6/1970 | Petersen | 166/343 |
| 3,604,731 | 9/1971 | Petersen | 285/29 |
| 3,688,840 | 9/1972 | Curington et al. . | |
| 3,710,859 | 1/1973 | Hanes et al. | 166/346 |

FOREIGN PATENT DOCUMENTS

| | | |
|---|---|---|
| 1531669 | 5/1968 | France . |
| 2009180 | 1/1970 | France . |
| 2009181 | 1/1970 | France . |
| 2084847 | 12/1971 | France . |
| 987309 | 3/1965 | United Kingdom . |

*Primary Examiner*—Dennis L. Taylor

*Attorney, Agent, or Firm*—Poms, Smith, Lande & Rose

[57] ABSTRACT

This invention concerns a seabed device to support tubing connected to a wellhead.

The device comprises a flange at the bottom end of the tubing, fitting into a rigid frame attached to and detachable from a framework located on the seabed, the said flange being connected to the wellhead by the same number of flexible pipes as there are passages in the tubing, with a connection-disconnection device to attach these flexible pipes to the wellhead.

This device relieves the wellhead of stresses transmitted by the tubing.

8 Claims, 6 Drawing Figures

4
5
24
9
11
12
22
13
10
1
23
3
6

CONNECTION-DISCONNECTION DEVICE BETWEEN TUBING AND UNDERWATER WELLHEAD FOR USE WITH ARTICULATED PRODUCTION INSTALLATIONS

This invention concerns a connection-disconnection device to attach tubing to an underwater wellhead, transferring mechanical forces exerted by the tubing to a structure located on the seabed, thereby relieving the wellhead from the effect of such stresses.

Articulated structures are frequently used to support platforms used for various operations involved in the exploration and operation of hydrocarbon fields at sea. It is also known that where such structures are articulated, and because of such articulations, the tubing is subject to mechanical bending stresses, whether or not it is off-centre in relation to the articulated structure. These bending stresses, combined with compressive forces resulting from the weight of the tubing and combining with this, have to be taken into account in calculating the various wellhead components and the guidance system at the bottom of the tubing.

This invention offers a way of relieving the wellhead from the effects of such stresses by transferring mechanical forces to a surrounding structure, already existing or specially provided for the purpose. Such a structure absorbs these stresses and transfers them to the seabed. This allows the tubing and the wellhead to be connected and disconnected by means of flexible pipes.

This new seabed device to support the tubing from a wellhead comprises a flange, containing the same number of passages as the tubing contains, and attached to the lower end of this tubing, this flange fitting into a rigid frame attached to and detachable from a seabed framework located on the seabed, the said flange being connected to the wellhead by the same number of flexible pipes as there are passages, these flexible pipes being attached at one end to the passages in the flange and at the other end to the corresponding passages in the wellhead, by means of a connection-disconnection device.

In embodiments where flexible pipes are to fit between two connection-disconnection devices, the flange is made up of two flange components, the first such component being attached to the lower end of the tubing and connected to the second flange component by a connection-disconnection device, the second such flange component fitting into a rigid frame, attached to and detachable from a framework located on the seabed, both flange components containing the same number of passages as the tubing, these passages connecting from one flange component to the other when both components are in the connection position, and the second flange component being connected to the wellhead by the same number of flexible pipes as the tubing contains passages.

The flexible pipes are attached to the wellhead by a connection-disconnection device on the wellhead, and are either fixed permanently to the flange or can be removed from it by a connection-disconnection device contained in the flange itself.

In embodiments of the invention, the framework on the seabed to which the rigid frame attached to the second flange is fixed consists either of at least two positioning guide-rods on the wellhead, which are fixed to the wellhead base-plate, or at least two centering rods, which are positioned on and fixed to a base located on the seabed and surrounding the wellhead and positioning guide-rods.

The invention will be more fully explained by the following description, without being confined to such embodiments, illustrated by the following figures.

Figure 1:
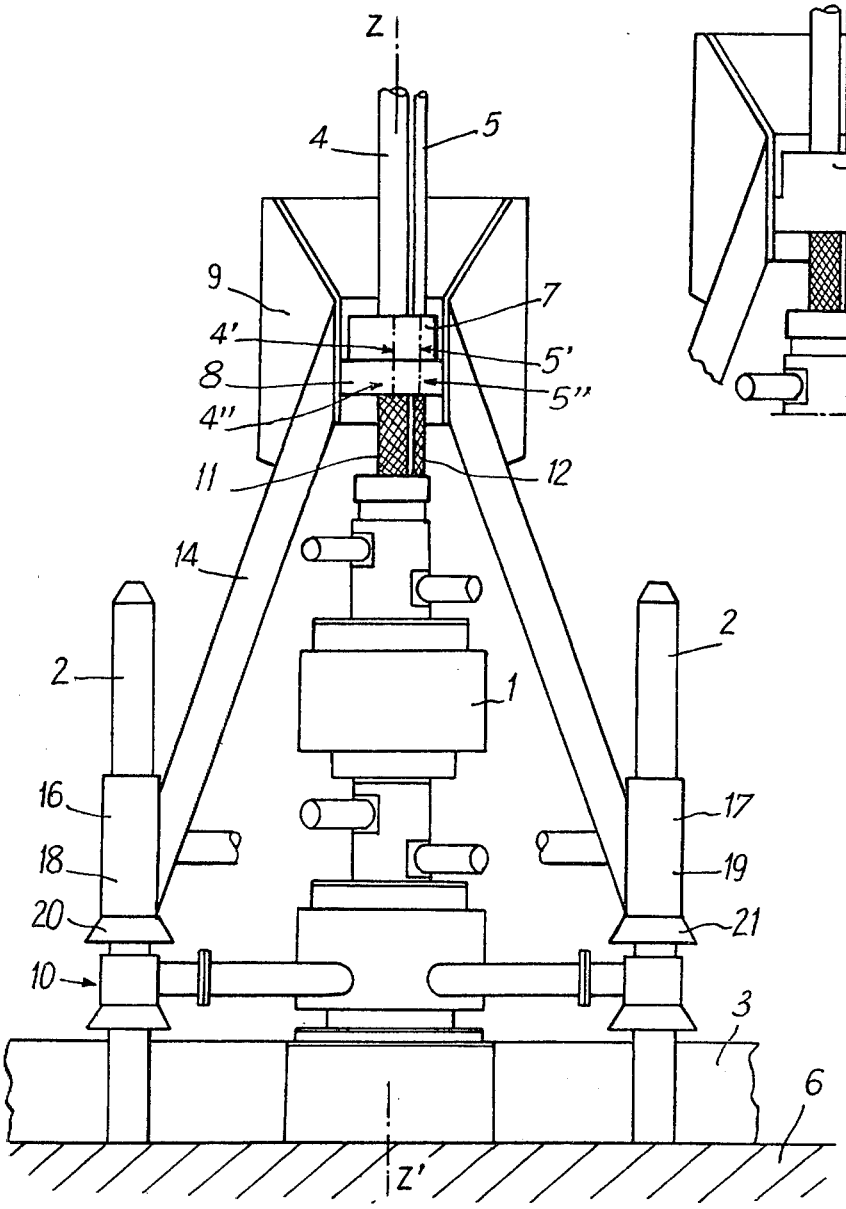
FIG. 1 is a diagrammatical view of a wellhead equipped with a locking connection-disconnection device supported by positioning guide-rods on the wellhead.

FIG. 1 shows a wellhead 1, on the centre-line ZZ', positioned on guide-rods 2, the axes of which form symmetrical pairs in relation to ZZ'. These axes and centre-lines ZZ' are perpendicular to a base-plate 3, to which the wellhead and rods are fixed. This base-plate is located on the seabed 6.

The wellhead 1 is surmounted and surrounded by an articulated steel structure, which carries the main tubing 4 and subsidiary tubing 5 of smaller diameter, connecting the wellhead on the seabed to an installation at the top of the articulated structure.

The tubing 4 and subsidiary tubing 5 connect up with corresponding passages in the wellhead, being connected to the wellhead by means of a device comprising two flanges 7 and 8. The first flange 7 is attached to the lower end of tubings 4 and 5, and can be connected to a second flange 8 by means of a connector-disconnector device. The flange 7 contains the same number of passages 4' and 5' indicated as center lines of the passages as there are tubings to be connected, and the second flange 8 contains corresponding passages 4'' and 5''. These passages connect up when both flanges are in the connected position.

The second flange 8 fits into a rigid frame 9, attached to and detachable from a framework 10 located on the seabed 6. This flange 8 is connected to the wellhead by the same number of flexible pipes 11 and 12 as there are tubings to be connected. These flexible pipes are attached to the wellhead 1 by a connector-disconnector device 13 on the wellhead, each such pipe being connected to one tubing.

In the embodiment illustrated in FIG. 1, the rigid frame 9 comprises arms 14 and 15, to the ends of which centering devices 16 and 17 are attached. These devices consist basically of cylindrical sleeves 18 and 19, ending at the bottom in truncated conical flared sections 20 and 21. These devices may fit to guide-rods 2 with some clearance, or may be equipped with a locking system to lock them in a particular position on these rods.

These centering devices 16 and 17 fit on to the guide-rods 2 used to position the wellhead, and fixed to the base-plate 3 on the seabed 6. The devices connect the lower flange 8 of the connector-disconnector device rigidly to the base-plate 3.

Figure 2:
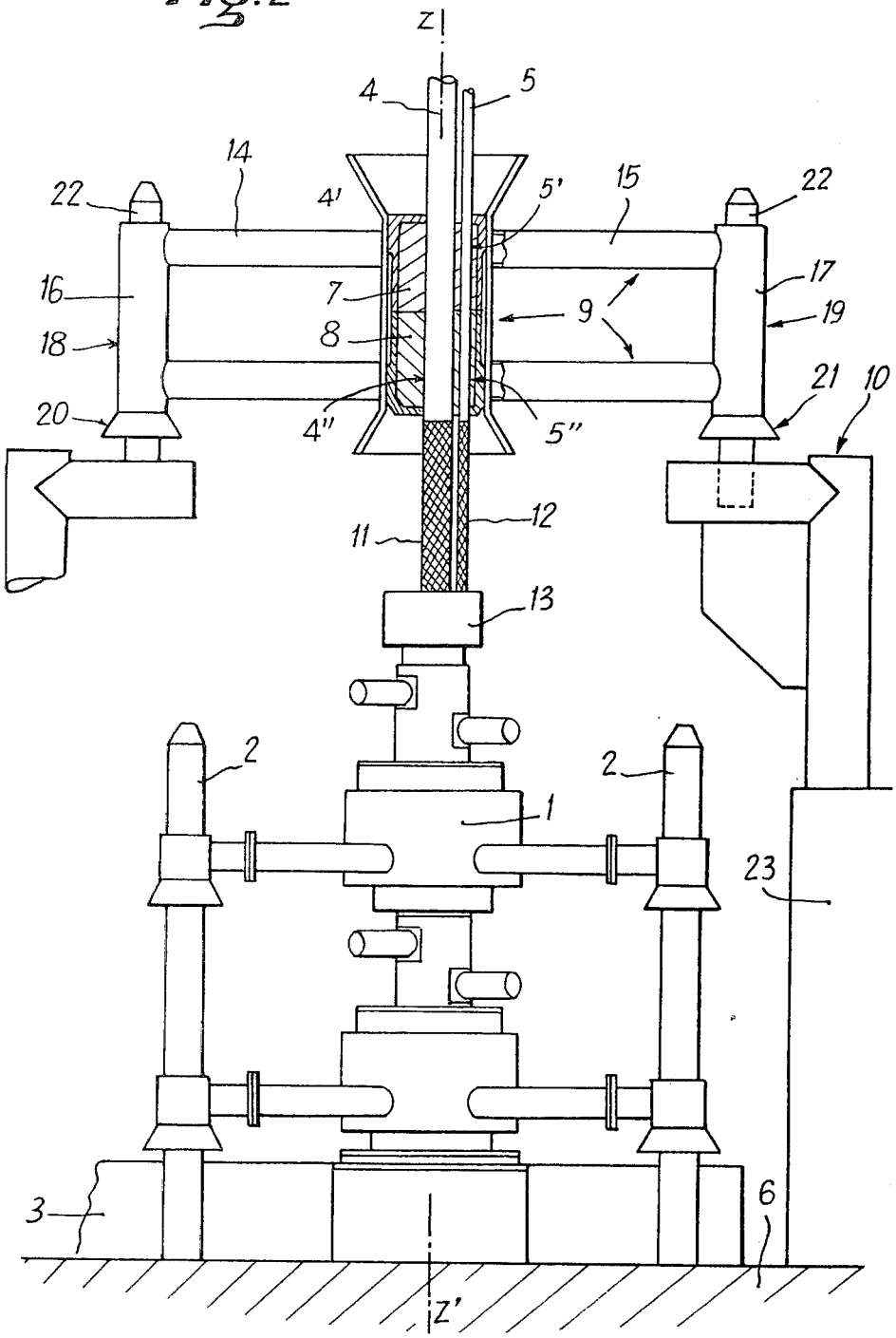
FIG. 2 is a diagrammatical view of a wellhead equipped with a locking connection-disconnection device supported by centering rods separate from the wellhead.

FIG. 2 shows the same component parts, with the same reference numerals as in FIG. 1.

The figure shows a wellhead 1, on a centre-line ZZ', positioned on guide-rods 2, the axes of which form symmetrical pairs in relation to ZZ'. These axes and centre-lines ZZ' are perpendicular to a base-plate 3, to which the wellhead and rods are fitted. This base-plate is located on the seabed 6.

The wellhead 1 is surmounted and surrounded by an articulated steel structure, which carries the main tubing 4 and subsidiary tubing 5 of smaller diameter, connecting the wellhead on the seabed to an installation at the top of the articulated structure.

The tubing 4 and subsidiary tubing 5 connect up with corresponding passages in the wellhead, connected to the wellhead by means of a device comprising two flanges 7 and 8. The first flange 7 is attached to the lower end of tubings 4 and 5, and can be connected to a second flange 8 by means of a connector-disconnector device. The flange 7 contains the same number of passages 4' and 5' as there are tubings to be connected and the second flange 8 contains corresponding passages 4'' and 5''. These passages connect up when both flanges are in the connected position.

The second flange 8 fits into a housing in a rigid frame 9, attached to and detachable from a framework 10 located on the seabed 6. This flange 8 is connected to the wellhead by the same number of flexible pipes 11 and 12 as there are tubings to be connected. These flexible pipes are attached to the wellhead 1 by a connector-disconnector device 13 on the wellhead, each such pipe being connected to one tubing.

In the embodiment illustrated in FIG. 2, the rigid frame 9 comprises arms 14 and 15, to the ends of which centering devices 16 and 17 are attached. These devices consist basically of cylindrical shafts 18 and 19, each ending at the bottom in truncated conical flare sections 20 and 21. These devices may fit to guide-rods 22 with some clearance, or may be equipped with a locking system to lock them in a particular position on these rods.

The framework 10 may be located directly on the seabed, or, as in FIG. 2, it may be embedded in a foundation block 23, located on and anchored to the seabed 6.

The installation shown in FIG. 2 has the advantage over the one shown in FIG. 1 of transferring stresses from the tubing to a framework that is completely separate from the wellhead base-plate.

Figure 3:
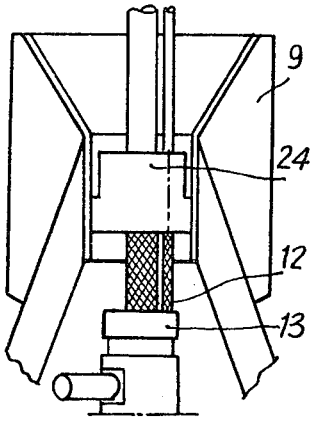
FIG. 3 shows a connection-disconnection device as shown in FIG. 1, with a single flange.

FIG. 3 shows a device similar to the one illustrated in FIG. 1, except that two flanges 7 and 8 in FIG. 1 are joined together to form a single flange 24, which fits into the rigid frame 9.

Figure 4:
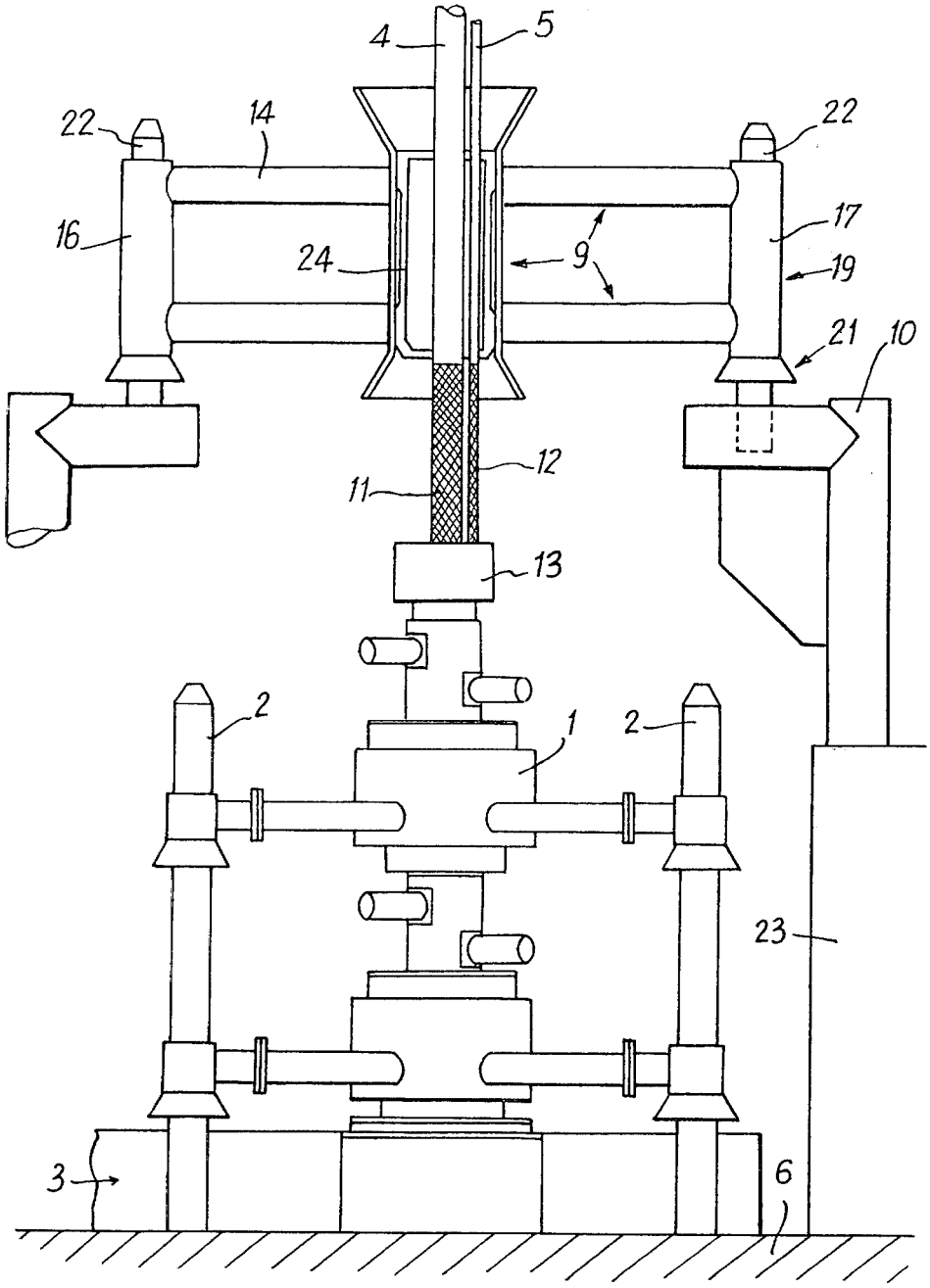
FIG. 4 shows a wellhead equipped with a connection-disconnection device as shown in FIG. 2, with a single flange.

FIG. 4 shows a device similar to the one illustrated in FIG. 2, in which the rigid frame 9 comprises centering devices 16 and 17 that will fit on to guide-rods 22 attached to a framework 10 embedded in a foundation block 23, which is separate from the base-plate 3 and located on the seabed 6.

The difference between the connector-disconnector device illustrated here and the one shown in FIG. 2 is that the two flanges 7 and 8 in FIG. 2 join together to form a single flange 24, which fits into the rigid frame 9.

The tubing is connected and disconnected by means of the connector 13, located between the flexible pipes 11 and 12 and the wellhead. The flange 24, fitting as it does into the rigid frame 9, transfers stresses from the tubing to the framework 10.

Figure 5:
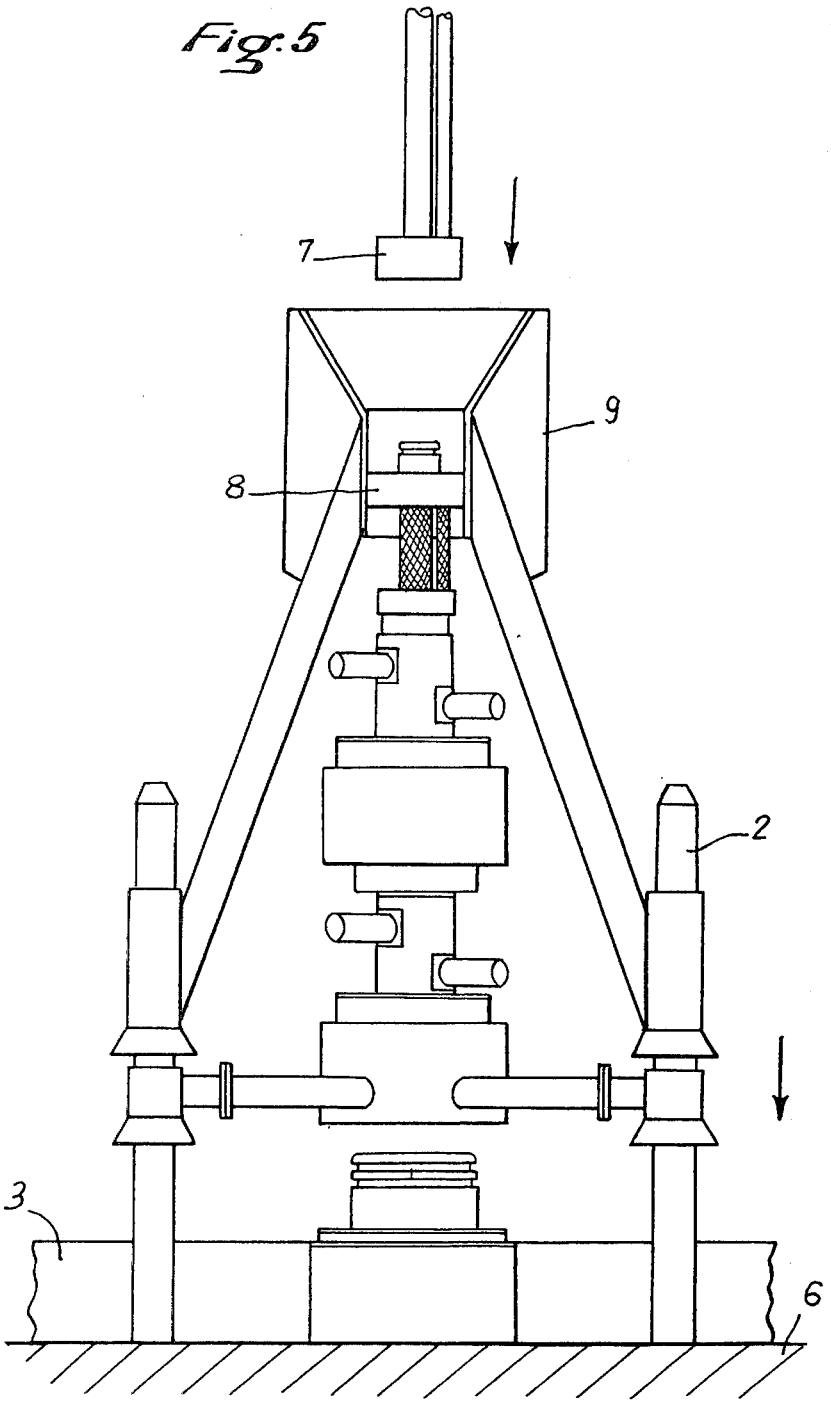
FIG. 5 shows how the device in FIG. 1 is installed.

FIG. 5 shows the two main stages of the installation procedure for the device illustrated in FIG. 1:

Stage 1: the wellhead is lowered, suspended from the rigid frame 9 by means of flexible pipes 11 and 12 connected to the flange 8 in the rigid frame. Centering devices position the wellhead and rigid frame over the guide-rods 2 until the wellhead is in place.

Stage 2: the tubing is connected to the flange 8 by means of the flange 7.

Figure 6:
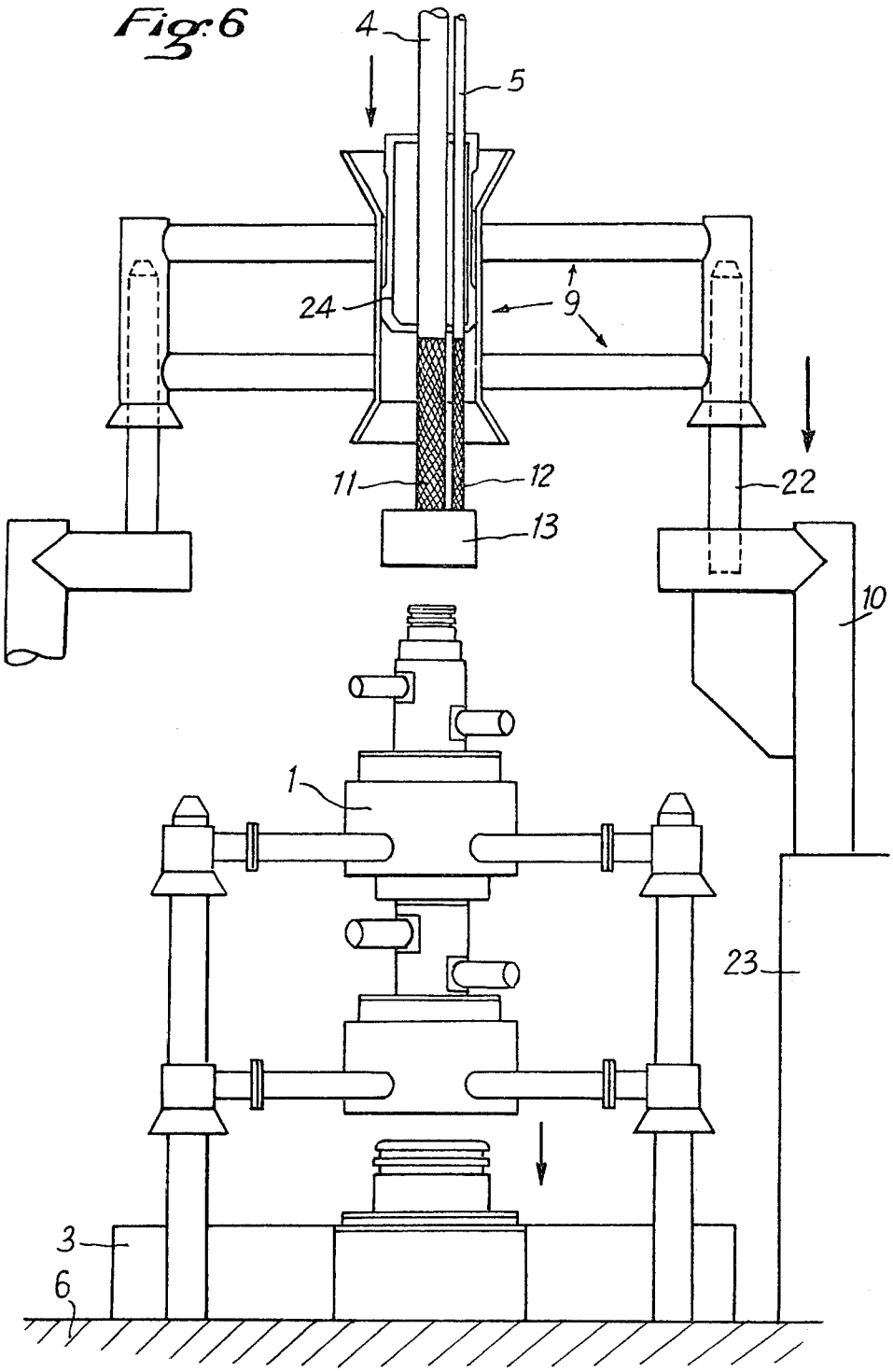
FIG. 6 shows how the device in FIG. 4 is installed.

FIG. 6 shows the three main stages of the installation procedure for the device illustrated in FIG. 4:

Stage 1: the wellhead 1 is lowered, positioned and connected to the base-plate 3.

Stage 2: the rigid frame 9 is then installed on the guide-rods 22 of the framework 10.

Stage 3: tubings 4 and 5 are fitted into the rigid frame 9 by means of the flange 24, while being joined on to the wellhead by the connector 13 on flexible pipes 11 and 12.

Problems involved in installing, removing and servicing underwater hyrocarbon production installations vary considerably. This invention has various embodiments, four of which have been described and illustrated in FIGS. 1, 2, 3 and 4. The invention is of course by no means confined to these particular embodiments: many variants are possible for someone skilled in the art without any departure from the spirit of the invention.

What is claimed is:

1. A new seabed device to support the tubing from a wellhead, comprising a flange, containing the same number of passages as the tubing contains, and attached to the lower end of this tubing, this flange fitting into a rigid frame attached to and detachable from a framework located on the seabed, the said flange being connected to the wellhead by the same number of flexible pipes as there are passages, these flexible pipes being attached at one end to the passages in the flange and at the other end to the corresponding passages in the wellhead, by means of a connection-disconnection device.

2. A device as defined in claim 1, in which the framework on the seabed to which the rigid frame containing the flange comprises at least two wellhead positioning guide-rods, which are attached to the wellhead base-plate.

3. A device as defined in claim 1, in which the framework on the seabed to which the rigid frame containing the flange comprises at least two centering rods, which are positioned on and fixed to a base located on the seabed and surrounding the wellheads and positioning guide-rods.

4. A device as defined claim 1, in which the flange is made up of two flange components, the first such component being attached to the lower end of the tubing and connected to the second flange component by a connection-disconnection device, the second such flange component fitting into a rigid frame attached to and detachable from a framework located on the seabed, both flange components containing the same number of passages as the tubing, these passages connecting from one flange component to the other when both components are in the connection position, and the second flange component being connected to the wellhead by the same number of flexible pipes as the tubing contains passages.

5. A device as defined in claim 4, in which the framework on the seabed to which the rigid frame containing the flange comprises at least two wellhead positioning guide-rods, which are attached to the wellhead base-plate.

6. A device as defined in claim 5, in which the framework on the seabed to which the rigid frame containing the flange comprises at least two centering rods, which are positioned on and fixed to a base located on the seabed and surrounding the wellhead and positioning guide-rods.

7. A seabed device to isolate and relieve a wellhead from stresses occurring in a tubing string above the wellhead and in flow communication with the wellhead, comprising in combination:

a framework located on the seafloor;

a rigid frame releasably attachable to said framework;

a flange means carried on the lower end of the tubing string;

a cooperable flange means carried by said rigid frame and for securing the lowering end of the tubing string in relation to said rigid frame;

passageway means in both of said flange means corresponding to passageways in the tubing string and in the wellhead; and flexible pipe means interconnecting the passageways in said flange means with corresponding passageways in said wellhead.

8. In an offshore installation having a wellhead at the seafloor and having a tubing string extending downwardly toward the wellhead for flow communication therewith, the provision of:

means for isolating the wellhead from stresses occurring in the tubind string comprising a rigid frame supported from the seafloor independently of the wellhead;

means on the lower end of said tubing string and means on the rigid frame cooperable to transmit stresses in the tubing string to the rigid frame;

and pipe means interconnecting passageways in said wellhead with passageways in said means on said rigid frame cooperable with the means on said tubing string.

* * * * *